US008157574B2

(12) United States Patent
Hsiao

(10) Patent No.: US 8,157,574 B2
(45) Date of Patent: Apr. 17, 2012

(54) POWER STRIP WITH COVERED SOCKETS

(75) Inventor: Feng-Shen Hsiao, Taipei (TW)

(73) Assignee: Rite-Tech Industrial Co., Ltd., Taipei (TW)

( * ) Notice: Subject to any disclaimer, the term of this patent is extended or adjusted under 35 U.S.C. 154(b) by 193 days.

(21) Appl. No.: 12/713,031

(22) Filed: Feb. 25, 2010

(65) Prior Publication Data

US 2011/0207351 A1 Aug. 25, 2011

(51) Int. Cl.
*H01R 33/94* (2006.01)

(52) U.S. Cl. ..... 439/131; 439/142; 439/640

(58) Field of Classification Search ..... 439/131, 439/640, 31, 165, 142
See application file for complete search history.

(56) References Cited

U.S. PATENT DOCUMENTS 4,583,798 A * 4/1986 Blazowich ..... 439/24
4,684,186 A * 8/1987 Hetherington ..... 439/171
4,875,871 A * 10/1989 Booty et al. ..... 439/209
4,985,806 A * 1/1991 Mazzullo et al. ..... 361/728
5,035,635 A * 7/1991 Tsai et al. ..... 439/188
5,162,616 A * 11/1992 Swaffield et al. ..... 174/99 B
5,350,310 A * 9/1994 Chen ..... 439/188
5,466,165 A * 11/1995 Boesel et al. ..... 439/142
5,658,152 A * 8/1997 Selker ..... 439/31
5,788,521 A * 8/1998 Milan ..... 439/214
5,885,109 A * 3/1999 Lee et al. ..... 439/652
5,957,701 A * 9/1999 McMillin ..... 439/13
6,015,307 A * 1/2000 Chiu et al. ..... 439/139
6,068,490 A * 5/2000 Salzberg ..... 439/25
6,118,643 A * 9/2000 Dyer et al. ..... 361/111
6,165,010 A * 12/2000 Prazoff ..... 439/534
6,220,880 B1 * 4/2001 Lee et al. ..... 439/214
6,332,794 B1 * 12/2001 Tzeng Jeng ..... 439/188
6,573,617 B2 * 6/2003 Jones et al. ..... 307/36
6,750,410 B2 * 6/2004 Lee ..... 200/51.03
6,854,989 B2 * 2/2005 Milan ..... 439/131
6,897,379 B1 * 5/2005 Hsiao ..... 174/53
6,913,467 B2 * 7/2005 Huang ..... 439/22
7,074,062 B2 * 7/2006 Khoury ..... 439/131
7,125,257 B1 * 10/2006 Liang ..... 439/22
7,264,514 B2 * 9/2007 Hsu et al. ..... 439/640
7,347,734 B1 * 3/2008 Teitelbaum ..... 439/652
7,374,425 B1 * 5/2008 Kuo et al. ..... 439/31
7,488,204 B2 * 2/2009 Hsu ..... 439/535
7,497,740 B2 * 3/2009 Mei et al. ..... 439/652
7,500,854 B2 * 3/2009 Gottstein ..... 439/13
7,510,426 B2 * 3/2009 Hwang et al. ..... 439/501
7,556,511 B1 * 7/2009 Hsu et al. ..... 439/119
7,625,241 B2 * 12/2009 Axland et al. ..... 439/640
7,695,292 B2 * 4/2010 Lee ..... 439/110

(Continued)

*Primary Examiner* — Neil Abrams
(74) *Attorney, Agent, or Firm* — Hershkovitz & Associates, LLC; Abraham Hershkovitz

(57) ABSTRACT

A power strip has a stationary base, at least one rotating base, at least one pintle and a power cable. The at least one rotating base is mounted rotatably on the stationary base. Each of the at least one rotating base has a top surface facing along a Z-axis and at least one socket mounted on the top surface and selectively covered by the stationary base by rotating each of the at least one rotating base to align with the stationary base. The at least one pintle faces along the Z-axis and rotatably connects the at least one rotating base to the stationary base. The power cable is mounted on the stationary base. The socket may be covered to prevent malfunction and shorting problems due to dust accumulation on the socket and prevent penetration by objects.

12 Claims, 24 Drawing Sheets

U.S. PATENT DOCUMENTS 7,753,682 B2 * 7/2010 Gerard ..... 439/13
7,771,239 B1 * 8/2010 Hsiao ..... 439/640
7,824,185 B2 * 11/2010 Chien ..... 439/11
7,845,974 B2 * 12/2010 Yue et al. ..... 439/501
7,874,856 B1 * 1/2011 Schriefer et al. ..... 439/214
7,881,034 B2 * 2/2011 Lee et al. ..... 361/118
7,911,757 B2 * 3/2011 Hsu et al. ..... 361/118
7,934,932 B1 * 5/2011 Lee et al. ..... 439/31
8,007,295 B2 * 8/2011 Lin ..... 439/131
8,011,930 B2 * 9/2011 Lee et al. ..... 439/18
8,033,867 B1 * 10/2011 Kessler et al. ..... 439/652
2011/0207351 A1 * 8/2011 Hsiao ..... 439/142

* cited by examiner

POWER STRIP WITH COVERED SOCKETS

BACKGROUND OF THE INVENTION

1. Field of the Invention

The present invention relates to a power strip, and more particularly to a power strip that has at least one covered socket, which is selectively revealed for access and covered for safety purposes.

2. Description of Related Art

A conventional power strip has a base and a power cable. The base has multiple sockets exposed to allow electric devices to be plugged in. The power cable electrically connects the multiple sockets to an external power source. However, the sockets are stationary and always exposed no matter whether they are employed or not. Furthermore, the exposed sockets easily accumulate dust thereon, which may raise probabilities of malfunction and shorting of the sockets and even further result in a risk of fire or electric shock should the sockets be on the ground and liquid be splashed or accumulate nearby.

Furthermore, the conventional power strip having multiple sockets has no folding means so is elongated and incompact and easily interferes with arrangement of adjacent articles, such as furnishings, electronics and the like.

To overcome the shortcomings, the present invention provides a power strip with covered sockets to mitigate or obviate the aforementioned problems.

SUMMARY OF THE INVENTION

The main objective of the invention is to provide a power strip that has at least one covered socket to selectively reveal the socket for accessing purposes or cover the socket for safety, compaction and attraction purposes.

In one aspect, a power strip in accordance with the present invention has a stationary base, at least one rotating base, at least one pintle and a power cable. The at least one rotating base is mounted rotatably on the stationary base. Each of the at least one rotating base has a top surface facing along a Z-axis of a three-dimensional coordinate system and at least one socket mounted on the top surface and selectively covered by the stationary base by rotating each of the at least one rotating base to align with the stationary base. The at least one pintle faces along the Z-axis and rotatably connects the at least one rotating base to the stationary base so that the at least one rotating base is capable of rotating on the stationary base around the Z-axis. The power cable is mounted on the stationary base.

In another aspect, a power strip in accordance with the present invention has a stationary base, a rotating base and a pintle. The stationary base has a recess having an inner lateral surface. At least one socket is formed on the inner lateral surface and faces along a direction being perpendicular to a Z-axis of a three-dimensional coordinate system. The rotating base is mounted rotatably on the stationary base, is selectively engaged with the recess and has an outer lateral surface covering and covered by the inner lateral surface when the rotating base is engaged with the recess. At least one socket is mounted on outer lateral surface and faces along a direction being perpendicularly to the Z-axis. The pintle faces along the Z-axis and rotatably connects the rotating base to the stationary base so that the rotating base is capable of rotating on the stationary base around the Z-axis. The power cable is mounted on the stationary base. The sockets of the stationary and rotating bases are covered when the rotating base is engaged with the recess of the stationary base.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
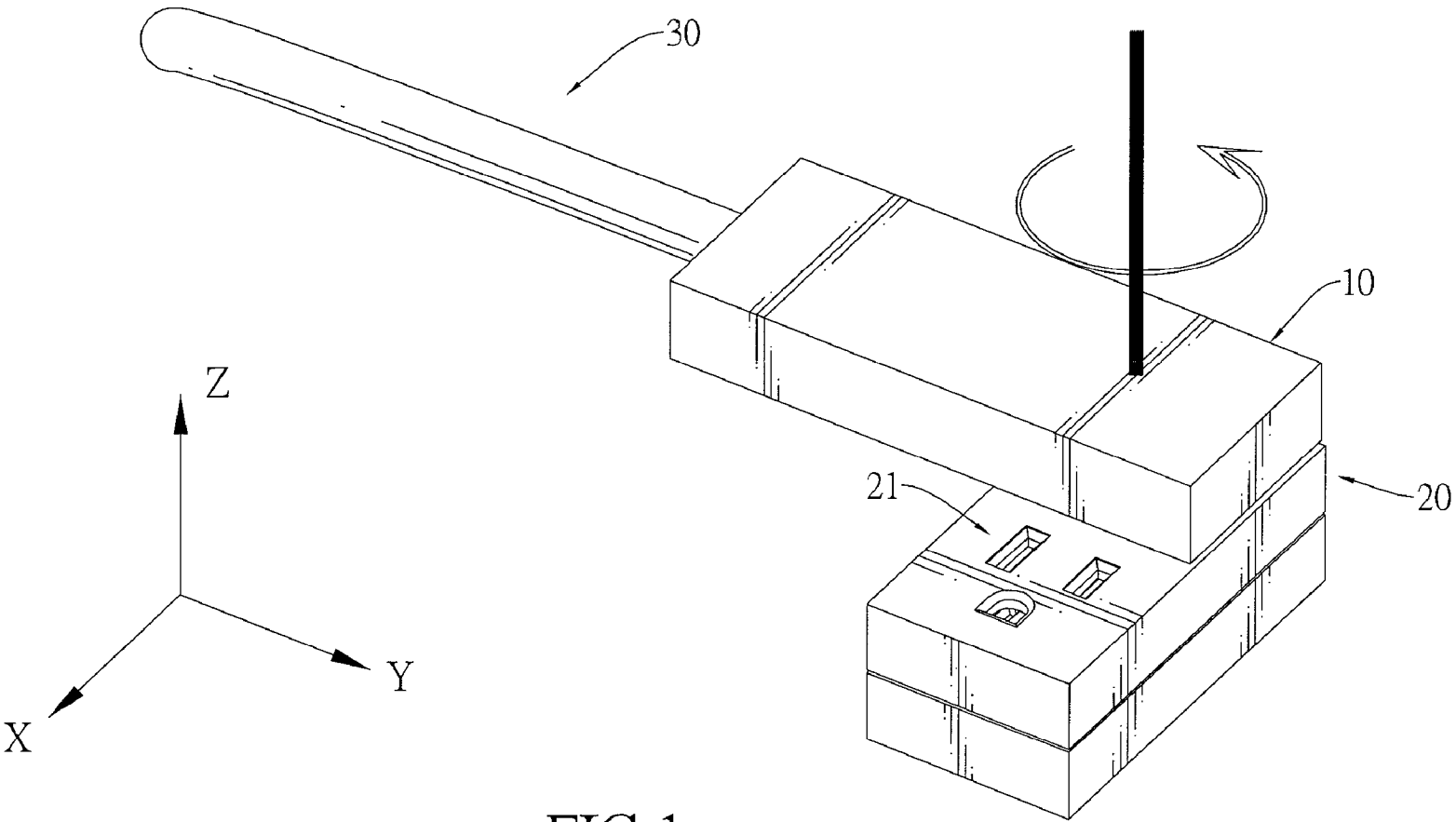
FIG. 1 is a perspective view of a first embodiment of a power strip with covered sockets in accordance with the present invention.
Figure 2:
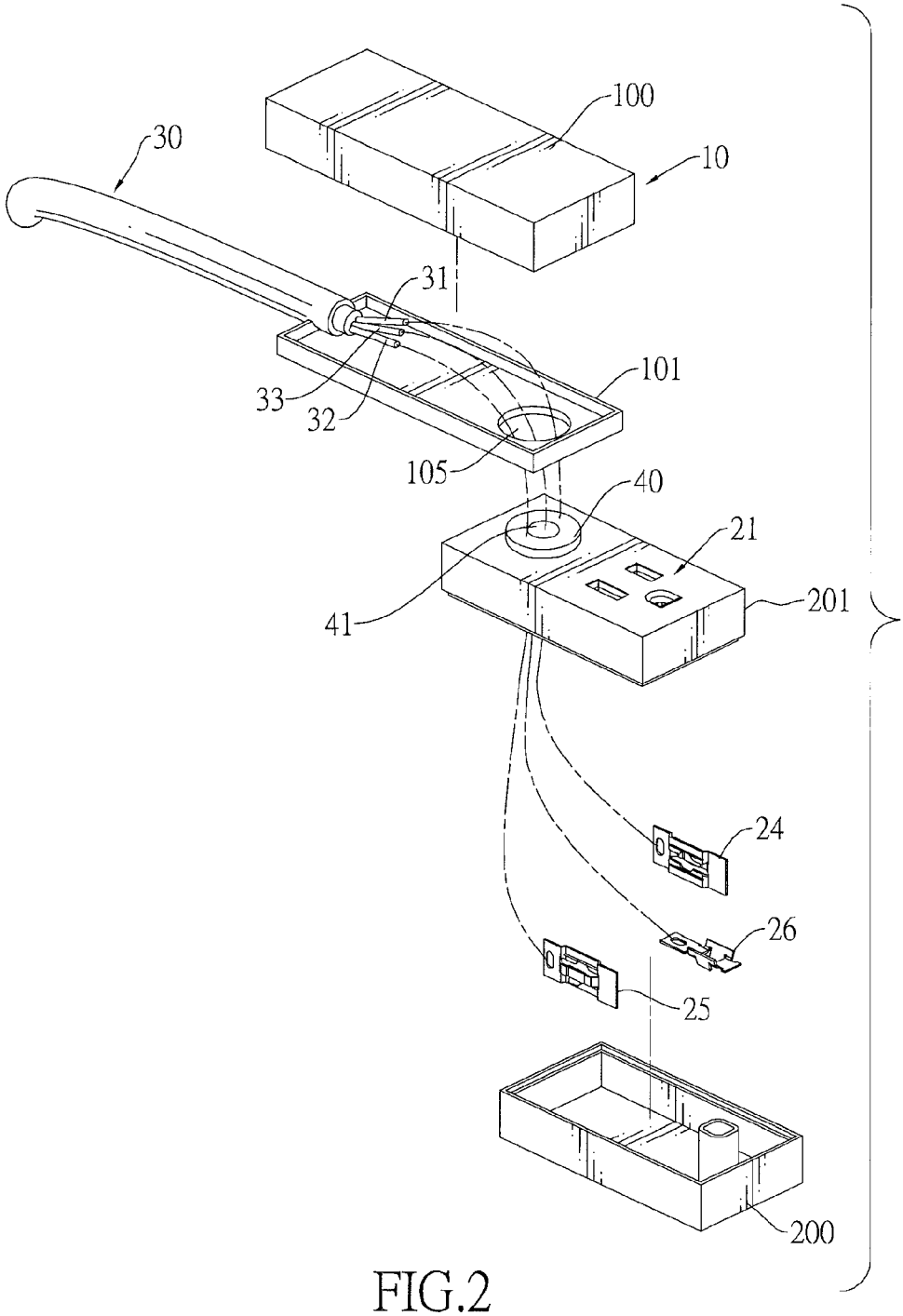
FIG. 2 is an exploded perspective view of the power strip in FIG. 1 showing a first variant of the blades of the socket.
Figure 3:
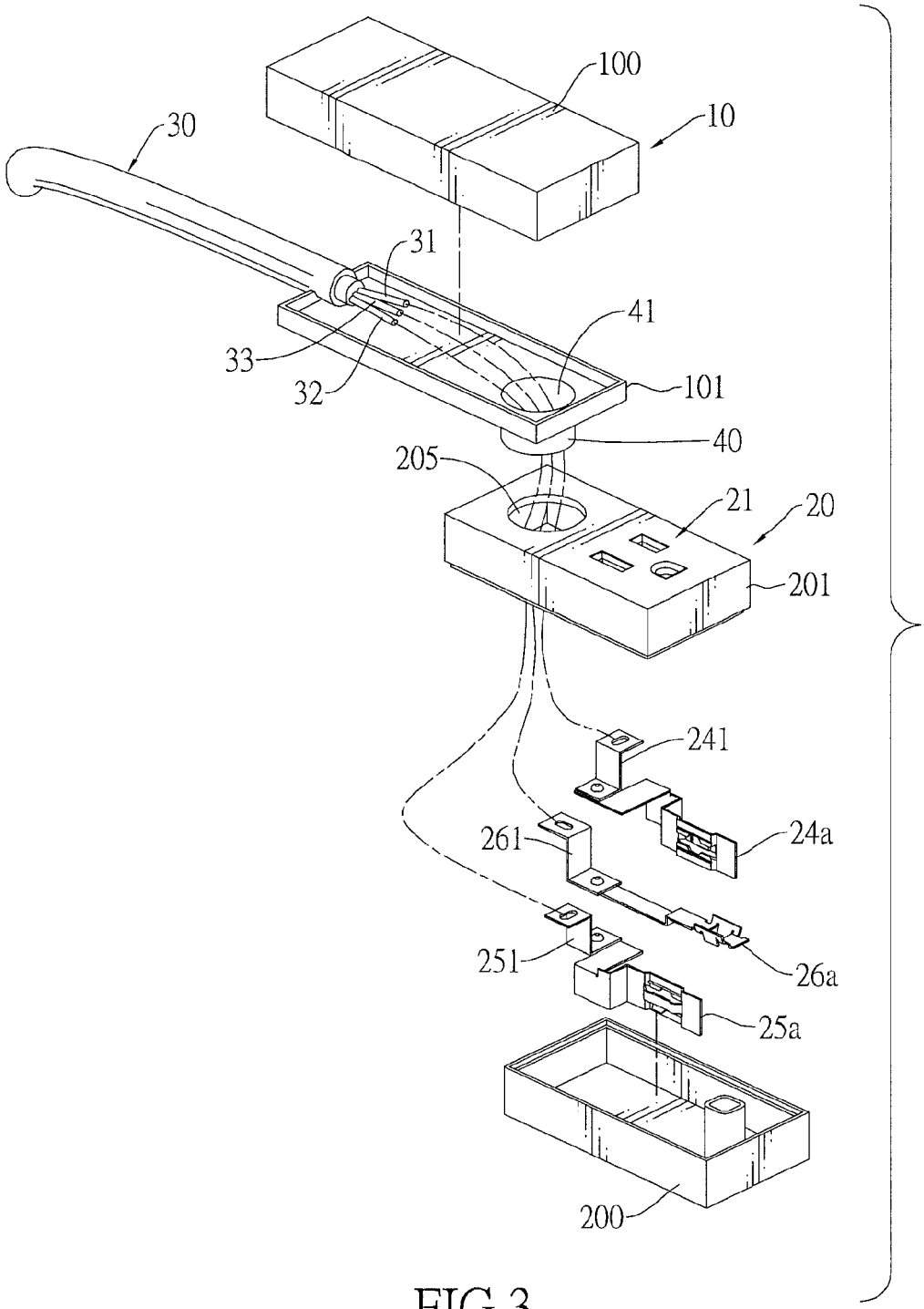
FIG. 3 is an exploded perspective view of the power strip in FIG. 1 showing a second variant of the blades of the socket.

With reference to FIGS. 1 to 3, a first embodiment of a power strip in accordance with present invention is set according to a three-dimensional coordinate system that has an X-axis, a Y-axis and a Z-axis being perpendicular to each other. The power strip comprises a stationary base (10), a rotating base (20), a pintle (40) and a power cable (30).

The stationary base (10) is hollow, may be assembled by two casings such as top and bottom casings (100, 101) and has a proximal end, a distal end and a bottom surface and may further have a pivot hole (105).

The distal end is defined opposite to the proximal end.

The bottom surface may face along the Z-axis.

The pivot hole (105) is defined through the bottom casing (101) of the stationary base (10) near the proximal end.

The rotating base (20) is hollow, is mounted rotatably on the proximal end of the stationary base (20), may be assembled by a top casing (201) and a bottom casing (200), has a top surface and a socket (21) and may further have a pivot hole (205).

The top surface faces along the Z-axis and is disposed adjacent to and is selectively covered by the bottom surface of the stationary base (10).

With reference to FIG. 2, the socket (21) is mounted on the top surface for engaging with a plug of an electronic device, faces along the Z-axis and is selectively covered by the bottom surface of the stationary base (10) by rotating the rotating base (20) to align with the stationary base (10). The socket (21) may have multiple contacting holes and multiple blades (24, 25, 26). The contacting holes are defined through the top surface. The blades (24, 25, 26) are conductive, may be live, neutral and ground contacts and are mounted securely in the rotating base (20) and correspond to the contacting holes for electrifying purposes. In a first variant of the blades (24, 25, 26), the blades (24, 25, 26) are mounted in the stationary base (10) instead of extending out thereof, as shown in FIG. 2.

The pintle (40) is mounted between the proximal end of the stationary base (10) and the rotating base (20), rotatably connects the rotating base (20) to the stationary base (10) so that the rotating base (20) is capable of rotating on the stationary base (10) around the Z-axis. The wiring hole (41) is defined through the pintle (40). Preferably, the pintle (40) is formed integrally and securely on the rotating base (20) and extends through the pivot hole (105) of the stationary base (10), as shown in FIG. 2.

The power cable (30) is mounted on the distal end of the stationary base (10) and may have a set of wires (31, 32, 33) connected respectively to the blades (24, 25, 26). In the first variant, the wires (31, 32, 33) extend through the wiring hole (41) of the pintle (40) from the stationary base (10) to the rotating base (20) to connect respectively to the blades (24, 25, 26).

With further reference to FIG. 3, in a second variant of the blades (24*a*, 25*a*, 26*a*) of the power strip, each blade (24*a*, 25*a*, 26*a*) further has a tab (241, 251, 261). The tab (241, 251, 261) is connected pivotally to the blade (24*a*, 25*a*, 26*a*), extends through the wiring hole (41) of the pintle (40) into the stationary base (10) to connect to wires (31, 32, 33) of the power cable and thus prevents the wire from extending through the pintle (40). The tab (241, 251, 261) has a fastening end and a pivoting end. The fastening end is mounted in the stationary base (10). The pivoting end is opposite to the fastening end and is mounted pivotally to the blade (24*a*, 25*a*, 26*a*). The pivot hole (205) is defined through the top casing (201) of the rotating base (20). Furthermore, the pintle (40) is formed integrally and securely on the stationary base (10) and extends through the pivot hole (205) of the rotating base (20), as shown in FIG. 3.

Figure 4:
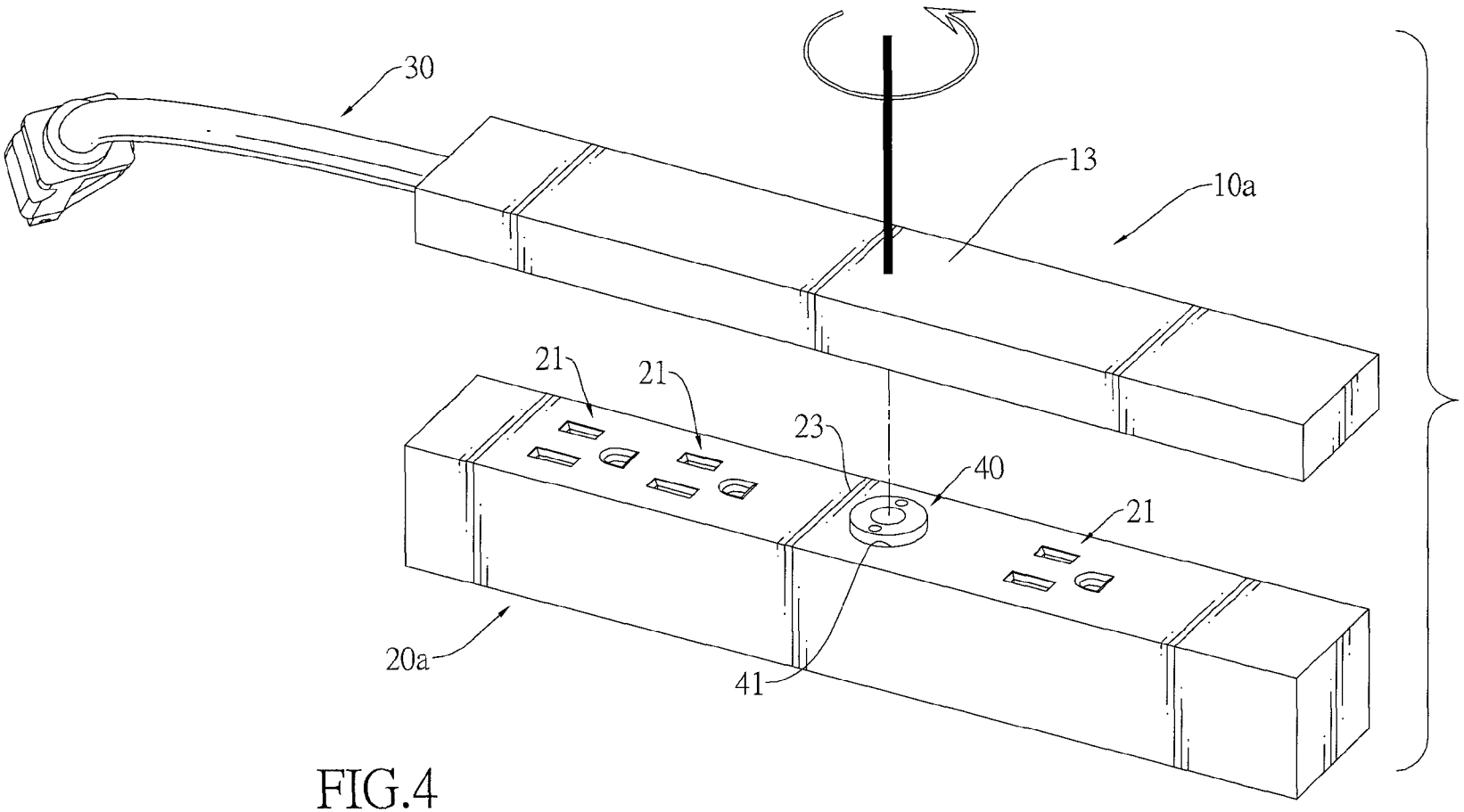
FIG. 4 is a partially exploded perspective view of a second embodiment of a power strip in accordance with the present invention.
Figure 5:
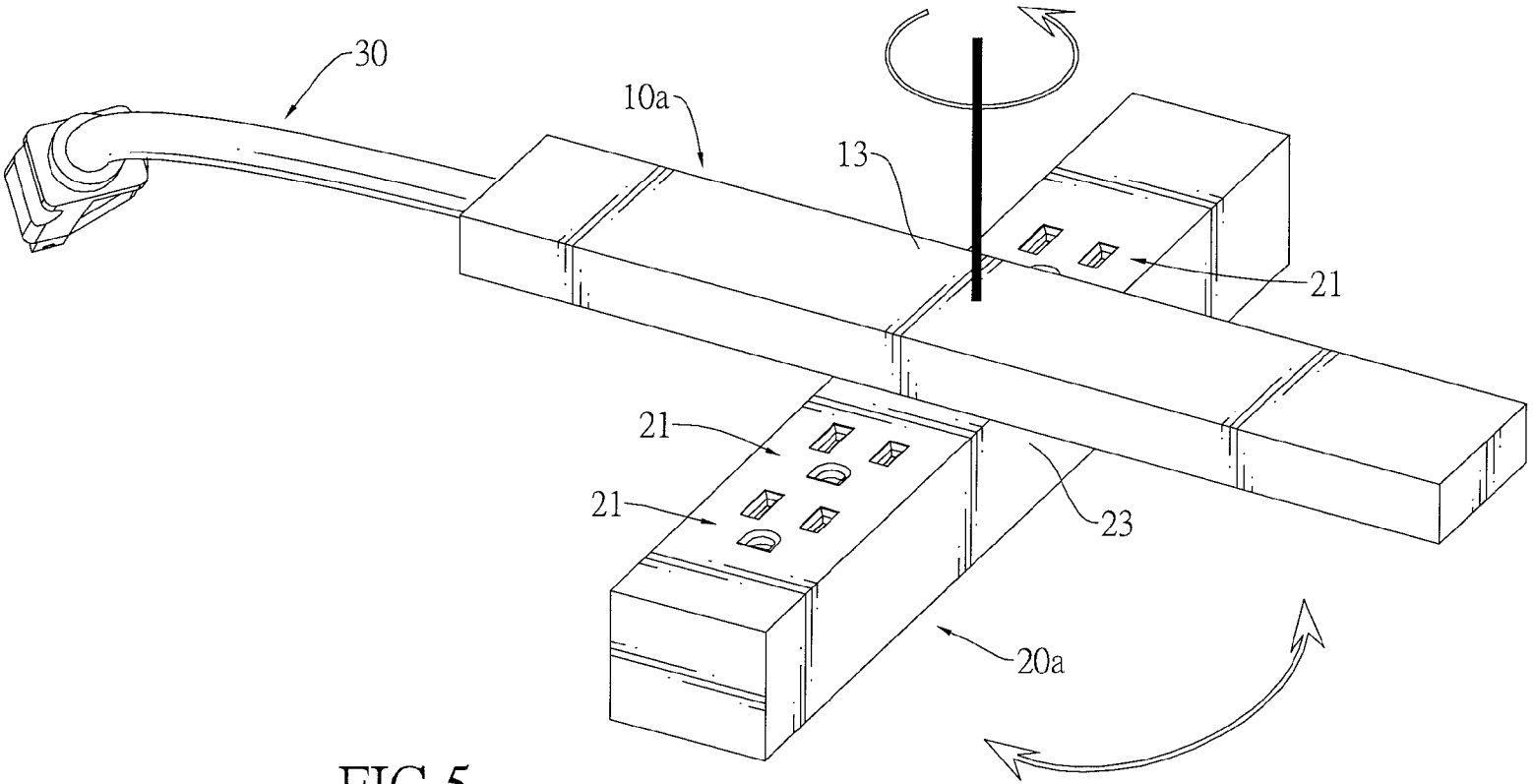
FIG. 5 is an operational perspective view of the power strip in FIG. 4.

With reference to FIGS. 4 and 5, a second embodiment of a power strip in accordance with the present invention has multiple sockets (21) mounted on the top surface of the rotating base (20*a*). The pintle (40) is mounted between an intermediate portion (13) of the stationary base (10*a*) and an intermediate portion (23) of the rotating base (20*a*). When the stationary base (10*a*) is aligned with and lapped over the rotating base (20*a*), the sockets (21) are covered. When the rotating base (20*a*) rotates and crosses with the stationary base (10*a*), the sockets (21) are revealed.

Figure 6:
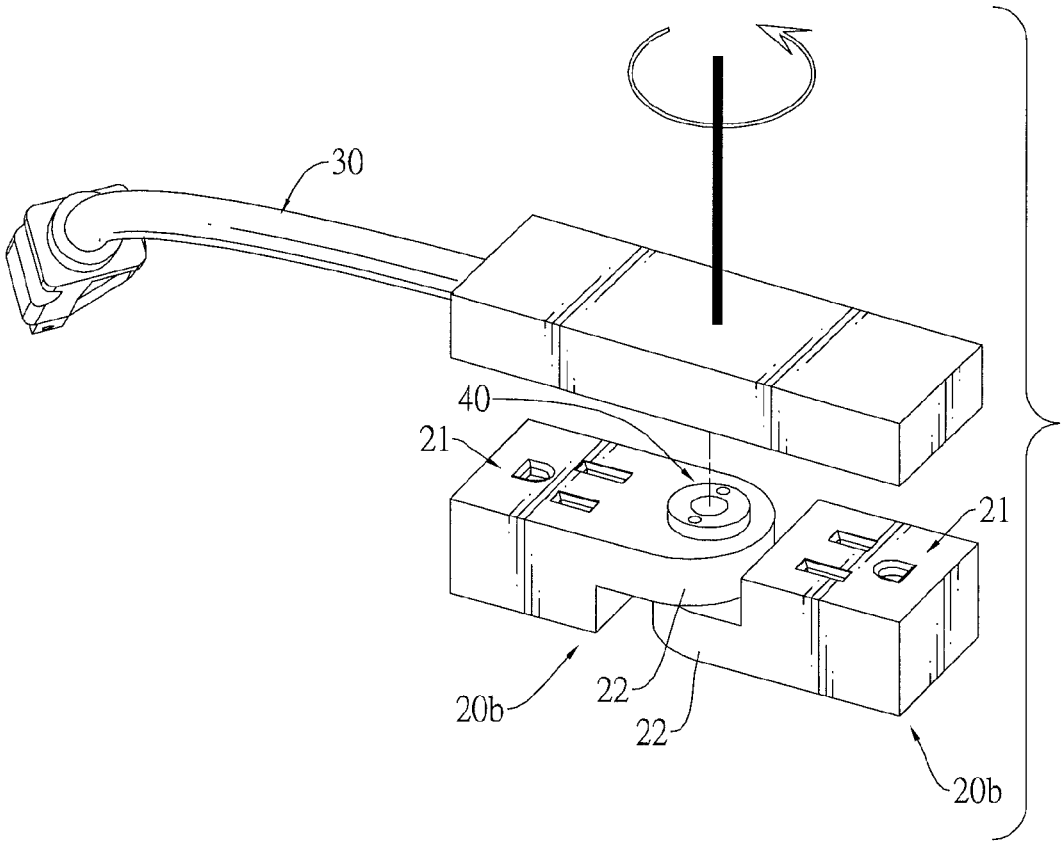
FIG. 6 is a partially exploded perspective view of a third embodiment of a power strip in accordance with the present invention.
Figure 7:
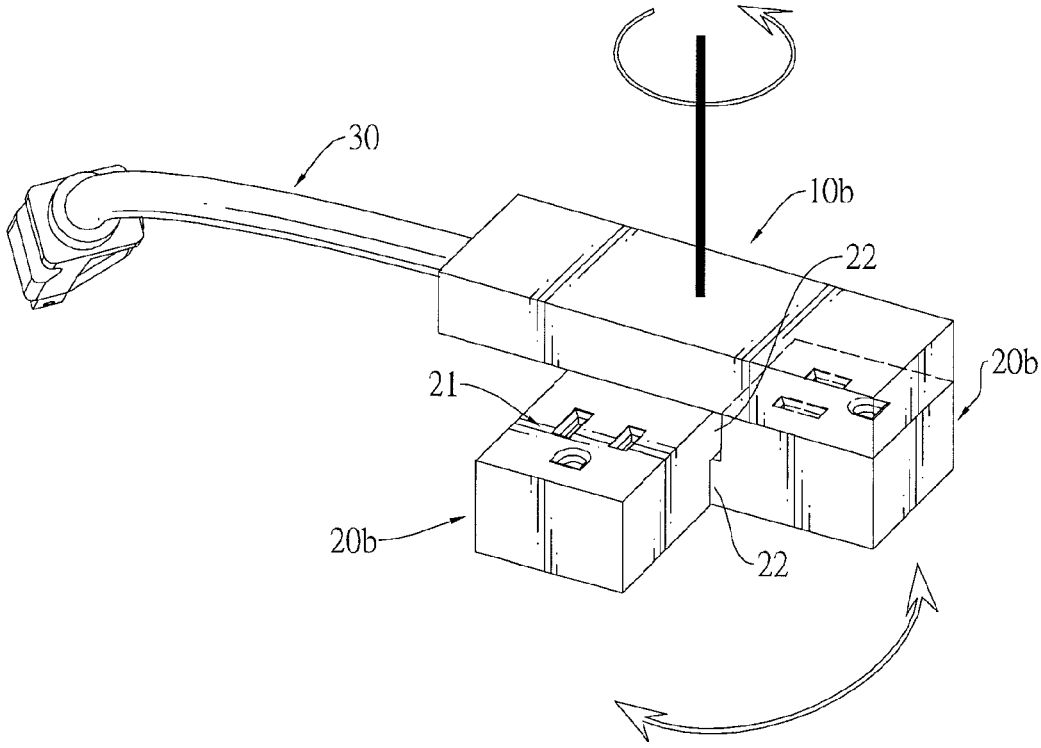
FIG. 7 is an operational perspective view of the power strip in FIG. 6.

With reference to FIGS. 6 and 7, a third embodiment of a power strip in accordance with the present invention has one stationary base (10*b*), multiple rotating bases (20*b*) and one pintle (40). Each rotating base (20*b*) has a recessed segment (22) facing along the Z-axis so that the recessed segments (22) of the rotating bases (20*b*) overlap to keep the sockets (21) level with each other. The rotating bases (20*b*) are mounted rotatably on the bottom surface of the stationary base (10*b*) by the single pintle (40) mounted through the recessed segments (22).

Figure 8:
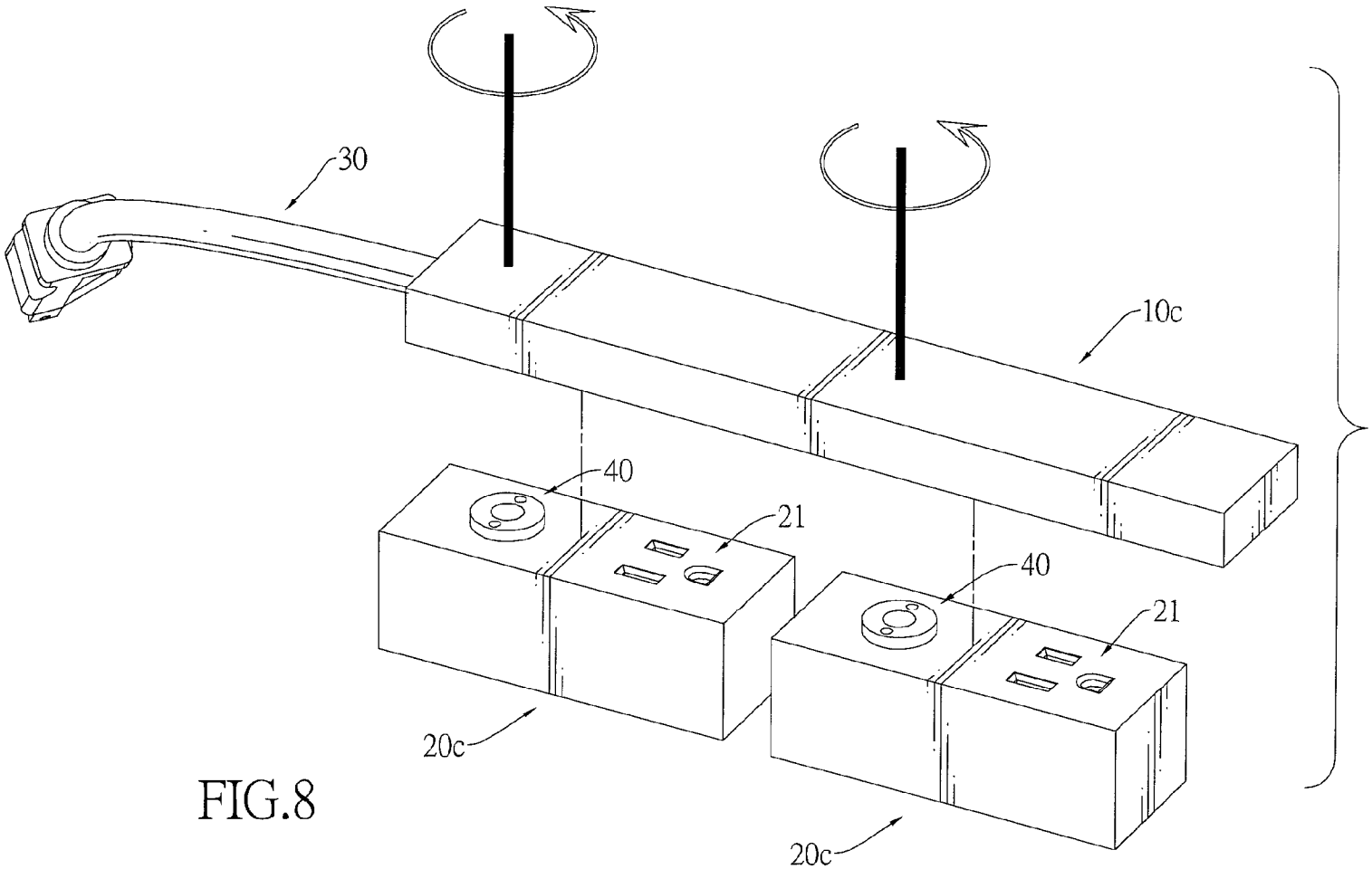
FIG. 8 is a perspective view of a fourth embodiment of a power strip in accordance with the present invention.
Figure 9:
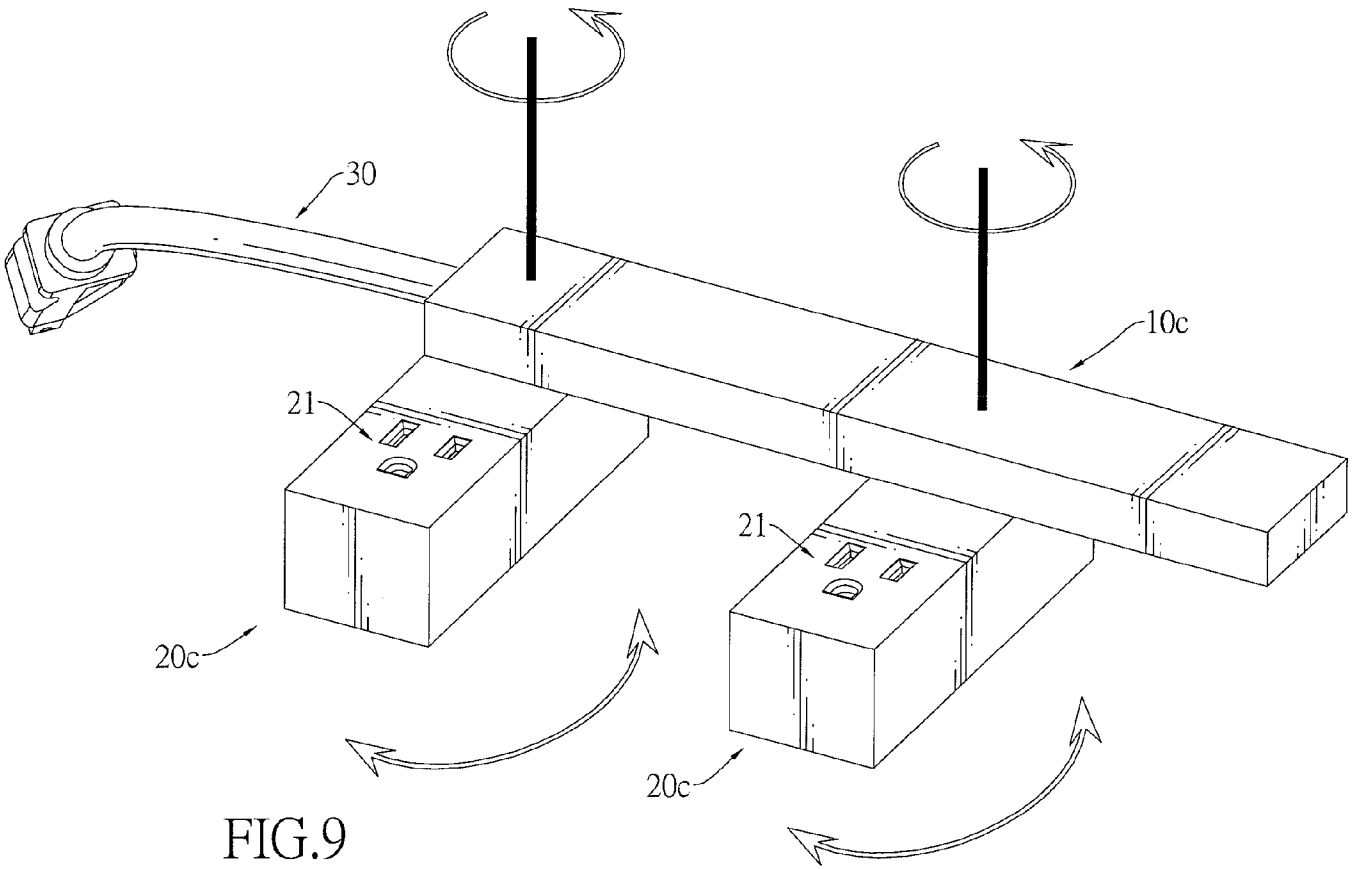
FIG. 9 is an operational perspective view of the power strip in FIG. 8.

With reference to FIGS. 8 and 9, a fourth embodiment of a power strip in accordance with the present invention has one stationary base (10*c*), multiple rotating bases (20*c*) and multiple pintles (40). The pintles (40) correspond to the rotating bases (20*c*) so that rotating bases (20*c*) are mounted rotatably on the stationary base (10*c*) respectively through the pintles (40). Furthermore, the rotating bases (20*c*) are arranged in a longitudinally when retracted to completely cover the sockets (21) thereof under the stationary base (10*c*).

Figure 10:
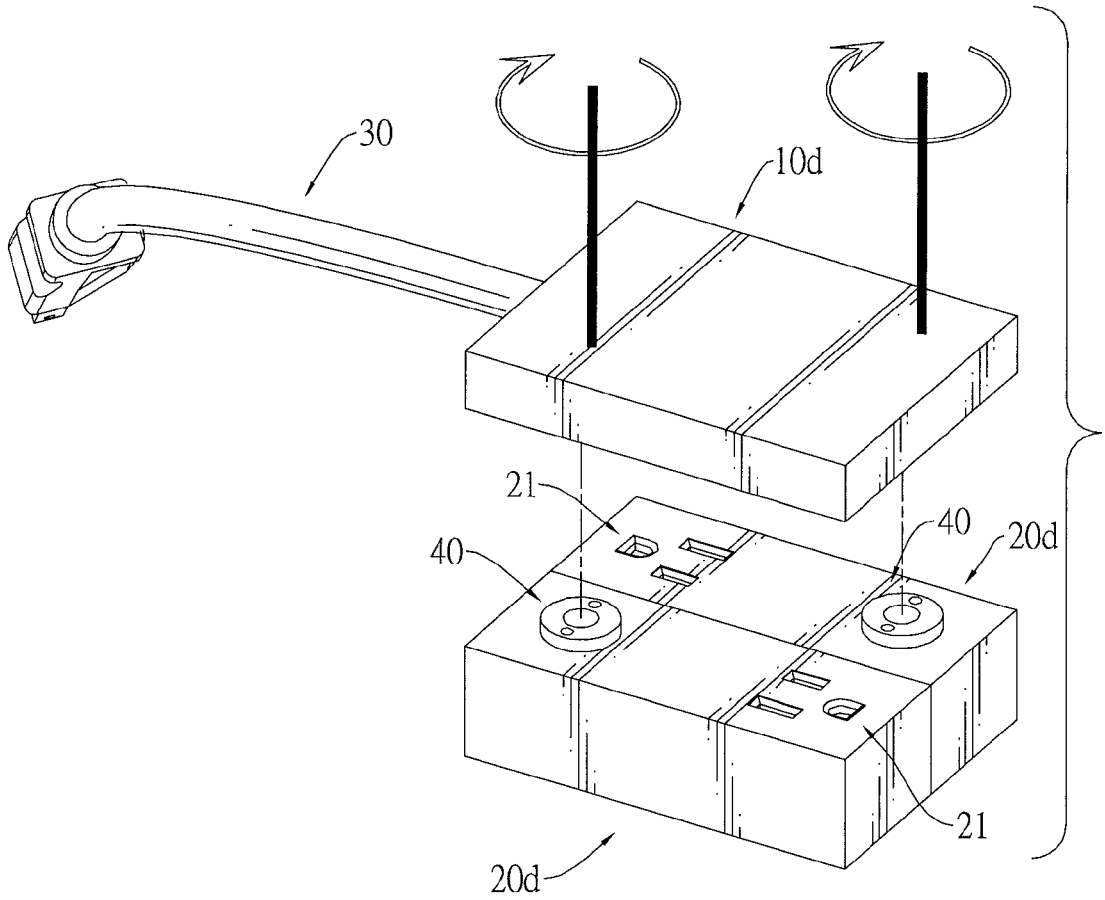
FIG. 10 is a partially exploded perspective view of a fifth embodiment of a power strip in accordance with the present invention.
Figure 11:
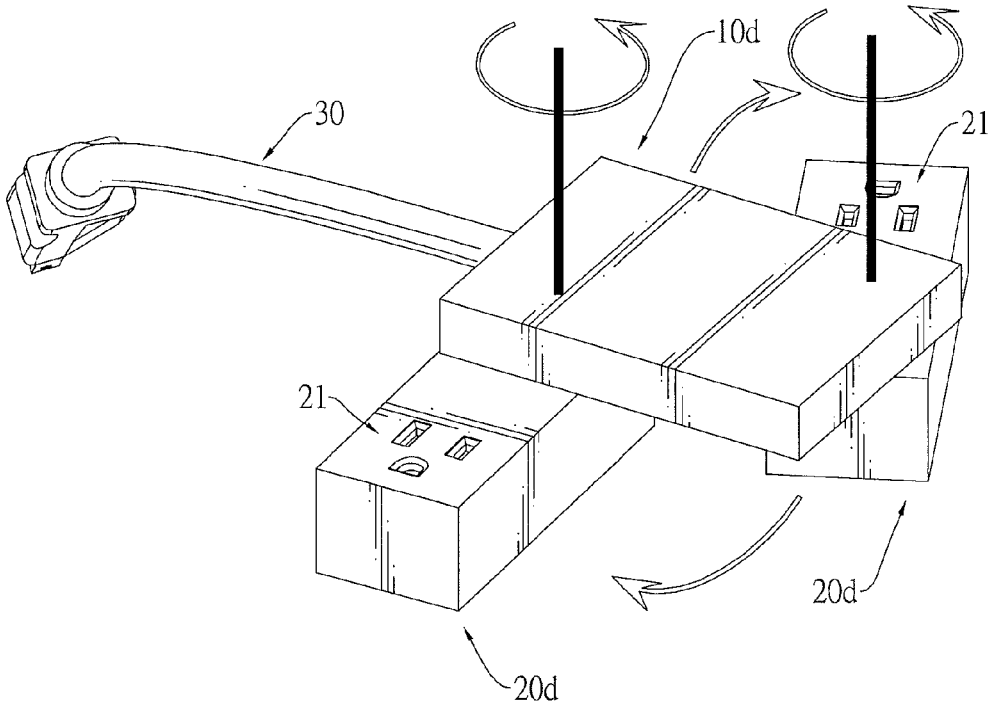
FIG. 11 is an operational perspective view of the power strip in FIG. 10.

With reference to FIGS. 10 and 11, a fifth embodiment of a power strip in accordance with the present invention has one stationary base (10*d*), two rotating bases (20*d*) and two pintles (40). The rotating bases (20*d*) are mounted rotatably on the stationary base (10*d*) respectively through the pintles (40) and are arranged abreast when retracted to completely cover the sockets (21) thereof under the stationary base (10*d*). When used, both the rotating bases (20*d*) rotate to extend out to reveal the sockets (21).

Figure 12:
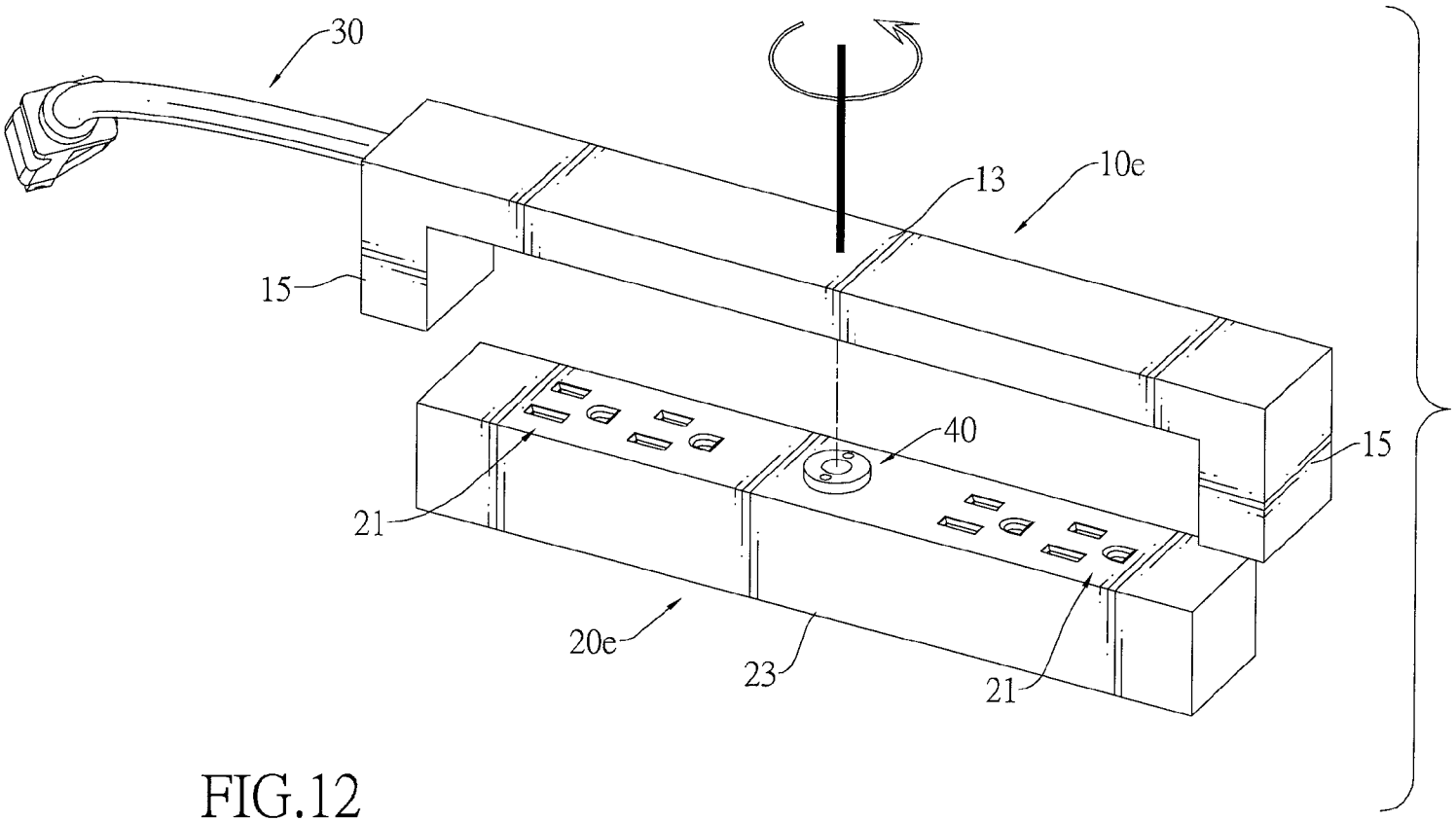
FIG. 12 is a partially exploded perspective view of a sixth embodiment of a power strip in accordance with the present invention.
Figure 13:
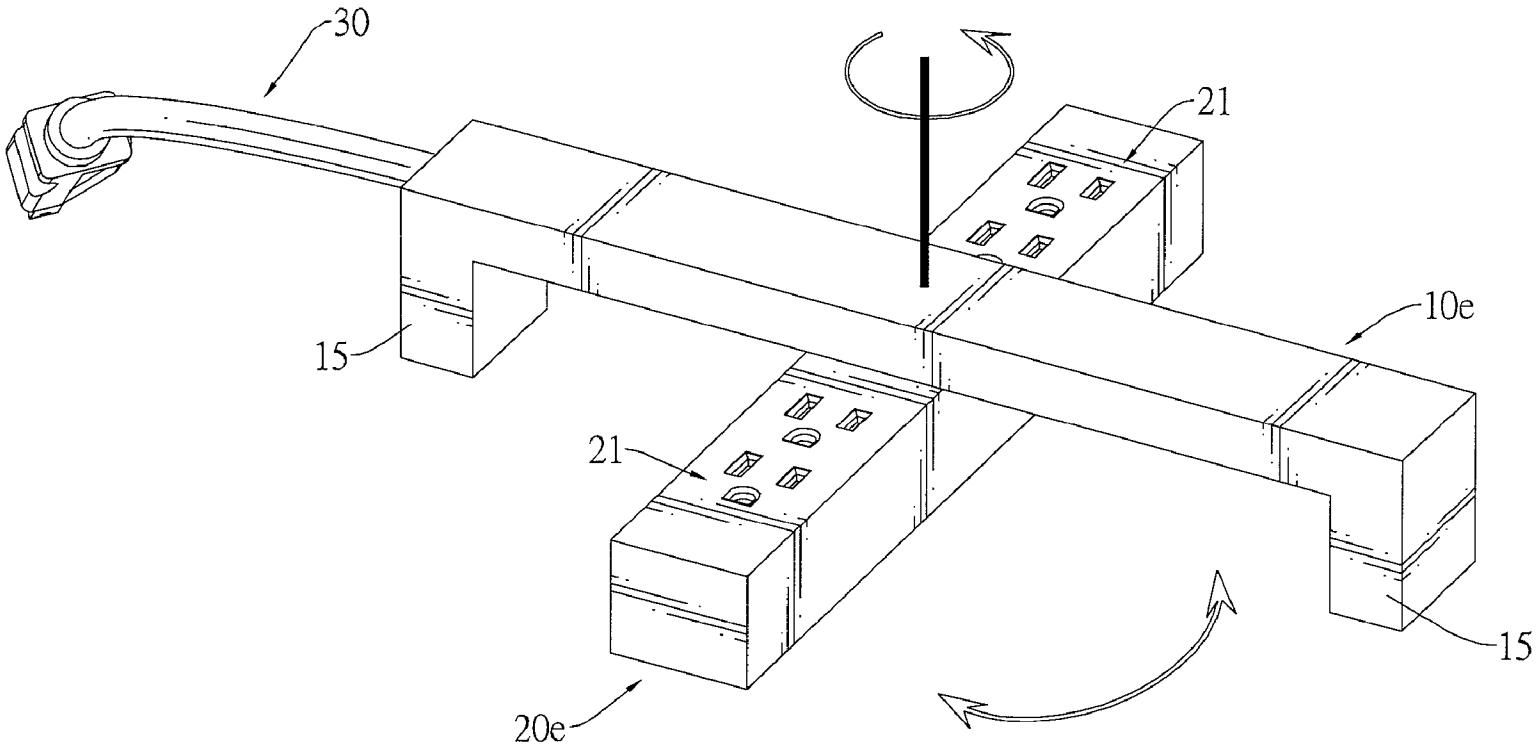
FIG. 13 is an operational perspective view of the power strip in FIG. 12.

With reference to FIGS. 12 and 13, a sixth embodiment of a power strip in accordance with the present invention has one stationary base (10*e*) and one rotating base (20*e*). The stationary base (10*e*) further has two feet (15) formed on and substantially protruding respectively from the proximal and distal ends for standing purposes. The rotating base (20*e*) is mounted rotatably on the stationary base (10*e*) through the pintle (40) connected therebetween and has multiple sockets (21) and selectively retracts between the feet (15).

Figure 14:
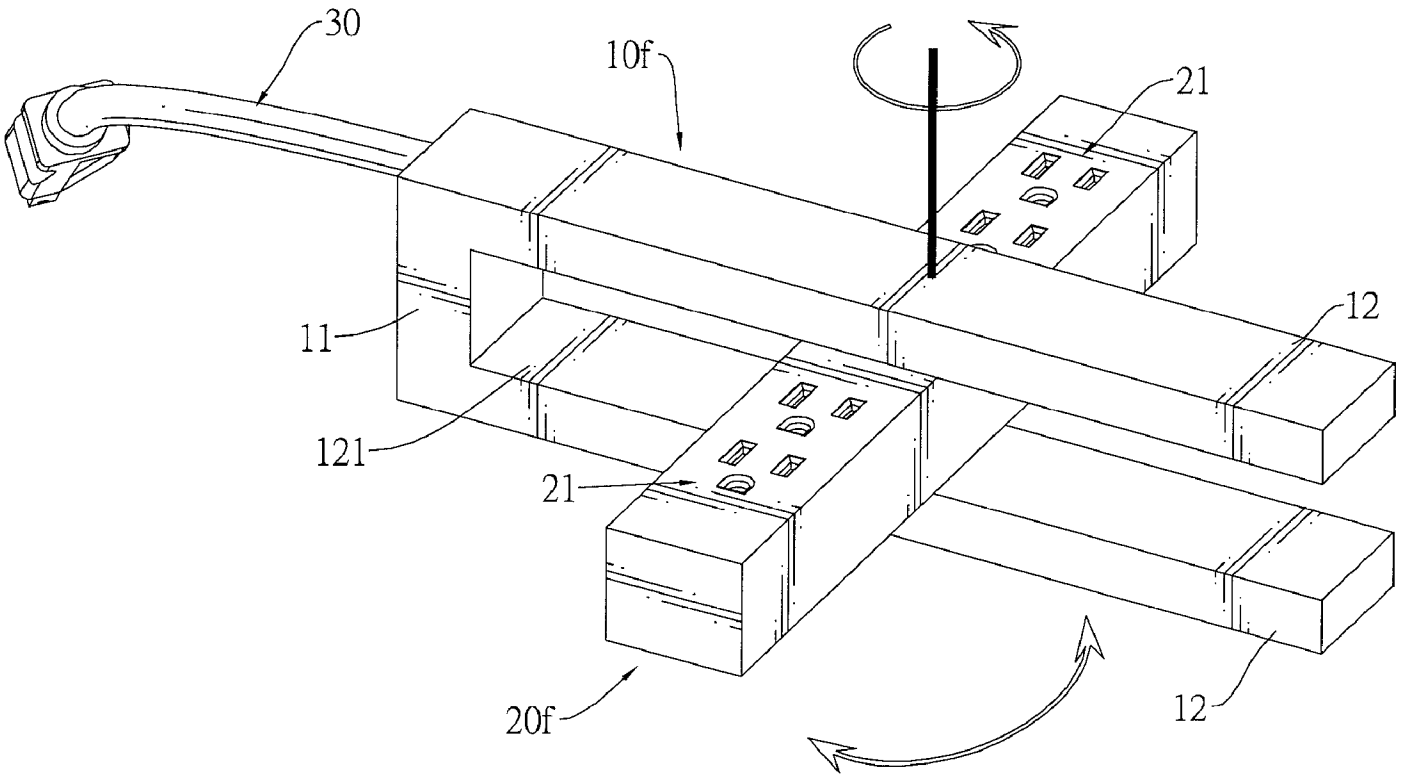
FIG. 14 is an operational perspective view of a seventh embodiment of a power strip in accordance with the present invention.

With reference to FIG. 14, a seventh embodiment of a power strip in accordance with the present invention has one stationary base (10*f*) and one rotating base (20*f*). The stationary base (10*f*) is substantially U-shaped, is connected to the power cable (30) and has an upright segment (11) and two level segments (12). The level segments (12) are formed on and protrude from the upright segment (11) to defined a slot (121) between the level segments (12). The rotating base (20*f*) is mounted rotatably in and selectively extends out of the slot (121) so that a lower one of the level segments (12) serves as a seat to prevent the rotating base (20*f*) from rubbing against articles underneath the rotating base (20*f*).

Figure 15:
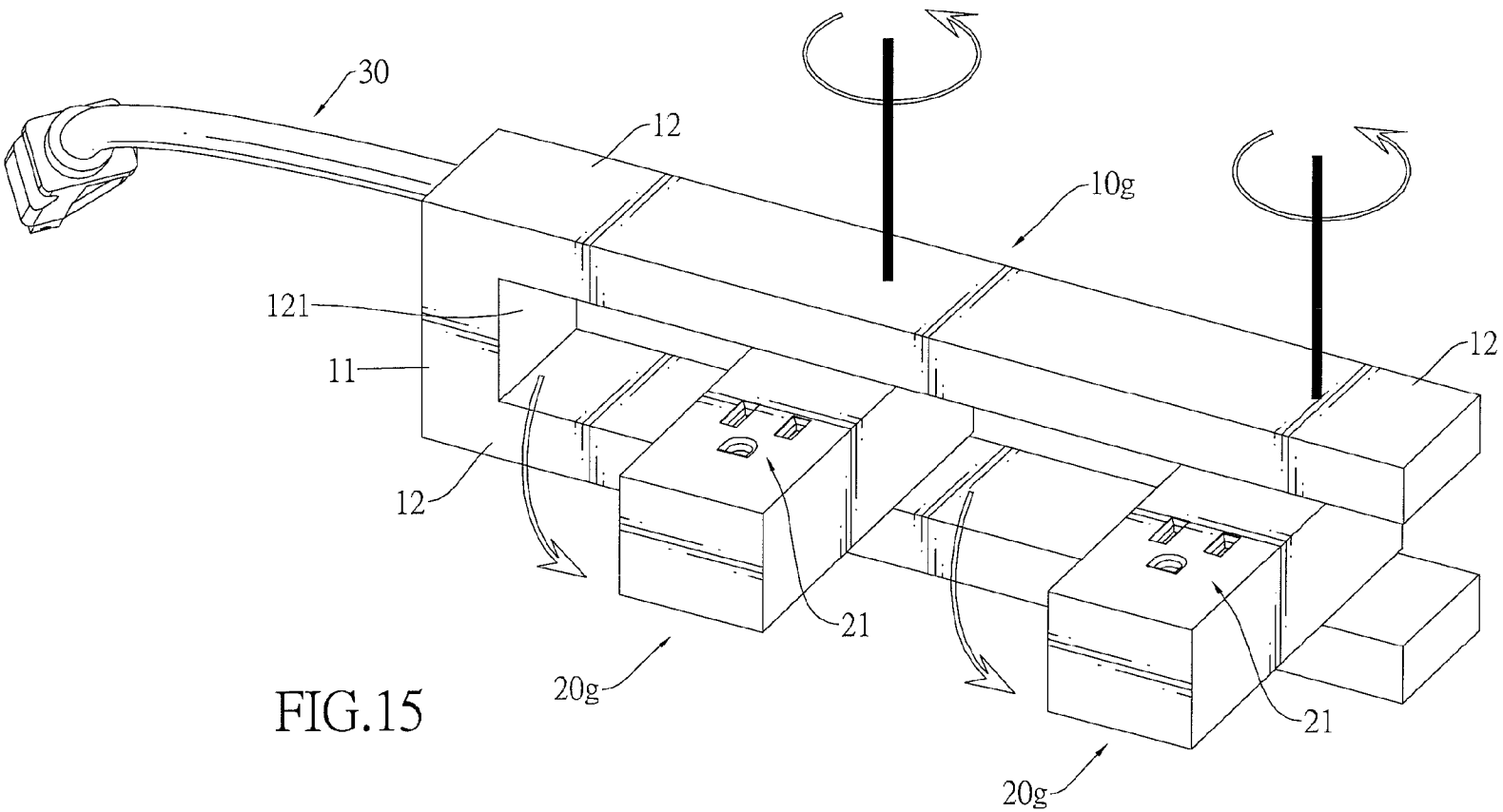
FIG. 15 is an operational perspective view of an eighth embodiment of a power strip in accordance with the present invention.

With reference to FIG. 15, an eighth embodiment of a power strip in accordance with the present invention has one stationary base (10*g*) and two rotating bases (20*g*). The stationary base (10*g*) is similar to that of the eighth embodiment. The rotating bases (20*g*) are mounted rotatably in the slot (121) respectively through two pintles (40).

Figure 16:
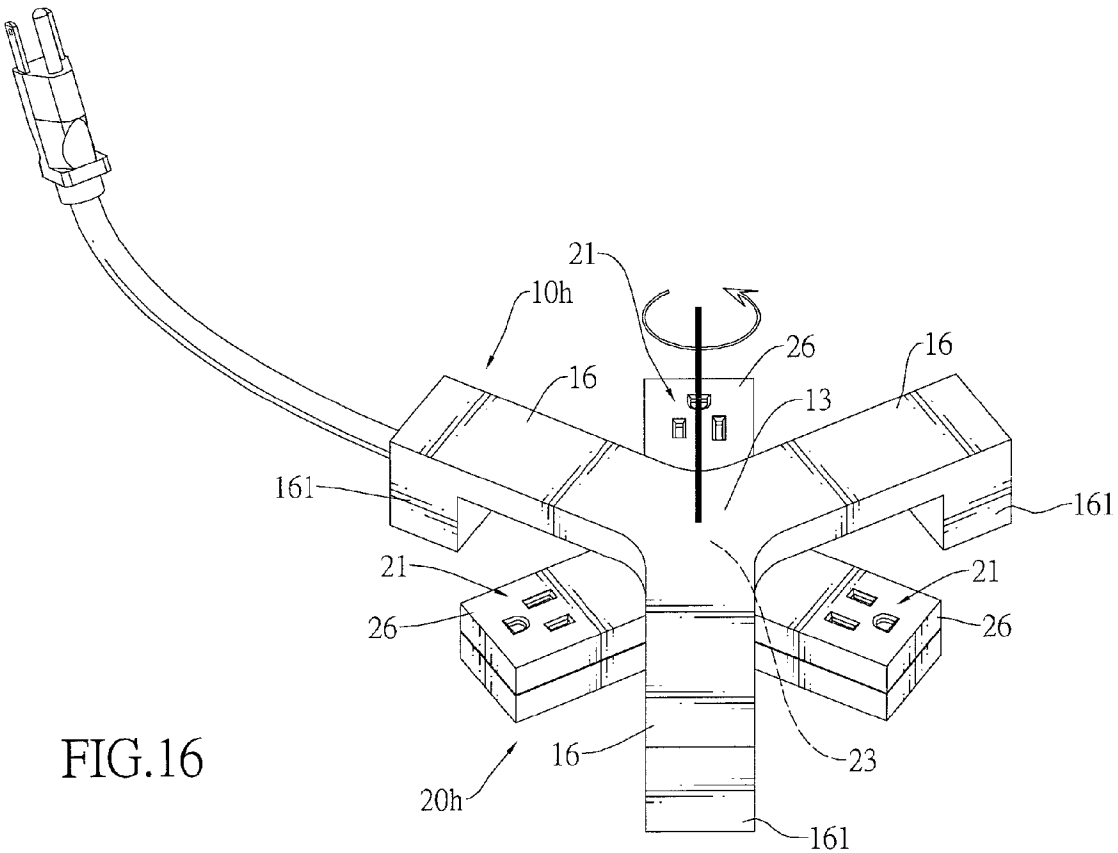
FIG. 16 is an operational perspective view of a ninth embodiment of a power strip in accordance with the present invention.

With reference to FIG. 16, a ninth embodiment of a power strip in accordance with the present invention has one stationary base (10*h*) and one rotating base (20*h*). The stationary base (10*h*) is polygonal, may be radial and have an intermediate portion (13) and multiple spokes (16). The spokes (16) are formed on and protrude radially from the intermediate portion (13). Each spoke (16) has a distal end and a foot (161) formed on and protruding substantially perpendicularly from the distal end of the spoke (16). The rotating base (20*h*) are polygonal and may be radial and have an intermediate portion (23) and multiple strips (26). The intermediate portion (23) is mounted rotatably on the intermediate portion (13) of the stationary base (10*h*). The strips (26) are formed on and protrude radially from the intermediate portion (23), correspond to the spokes (16) and each strip (26) has at least one socket (21). When the rotating base (20*h*) is retracted, the strips (26) are aligned respectively with the spokes (16) to cover and cover all of the sockets (21).

Figure 17:
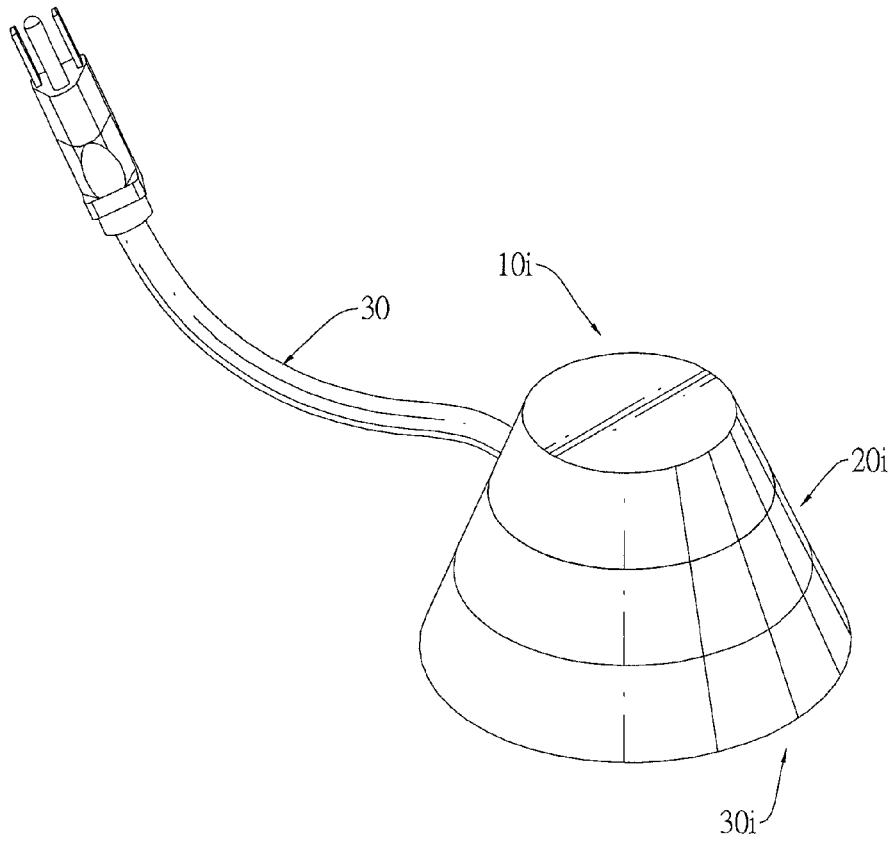
FIG. 17 is a perspective view of an tenth embodiment of a power strip in accordance with the present invention.
Figure 18:
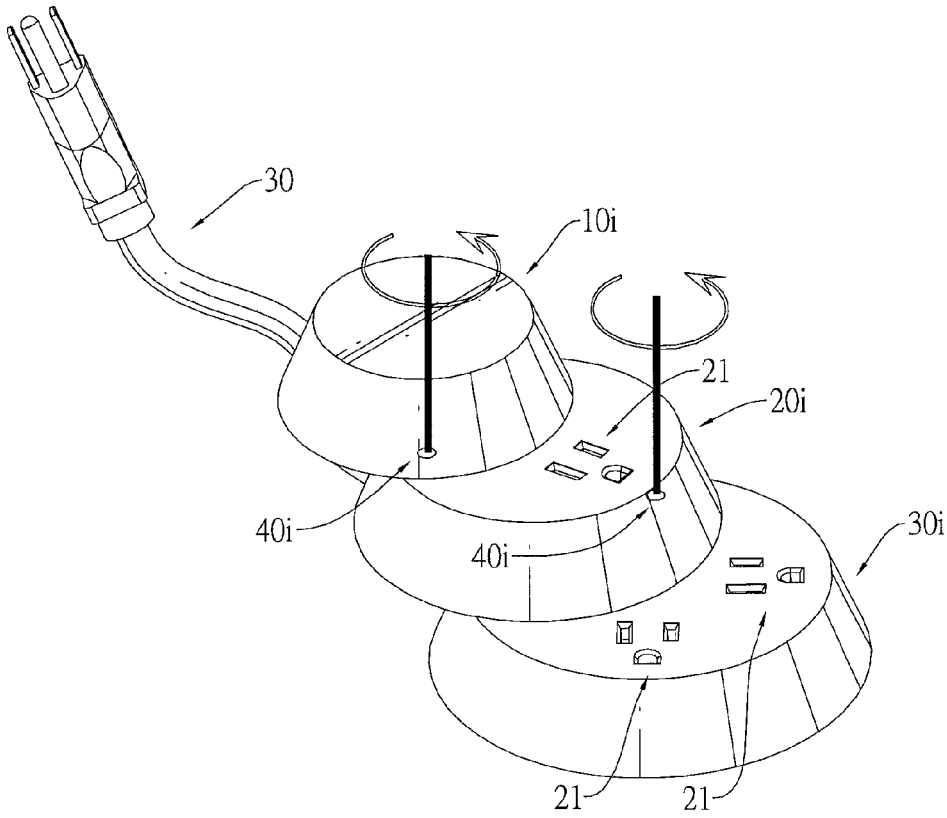
FIG. 18 is an operational perspective view of the power strip in FIG. 17.

With reference to FIGS. 17 and 18, a tenth embodiment of a power strip in accordance with the present invention has one stationary base (10*i*) and multiple rotating bases (20*i*, 30*i*). The stationary base (10*i*) and rotating bases (20*i*, 30*i*) are vertically stacked and rotatably connected to one another. Adjacent two of the stationary and rotating bases (10*i*, 20*i*, 30*i*) have one pintle (40*i*) mounted therebetween to ensure the rotating bases (20*i*, 30*i*) to selectively rotate out to reveal the at least one socket (21) thereon or retract to cover the at least one socket (21). Moreover, the stationary and rotating bases (10*i*, 20*i*, 30*i*) are configured into a specific shape such as a flat-topped cone or the like when the sockets (21) are covered.

Figure 19:
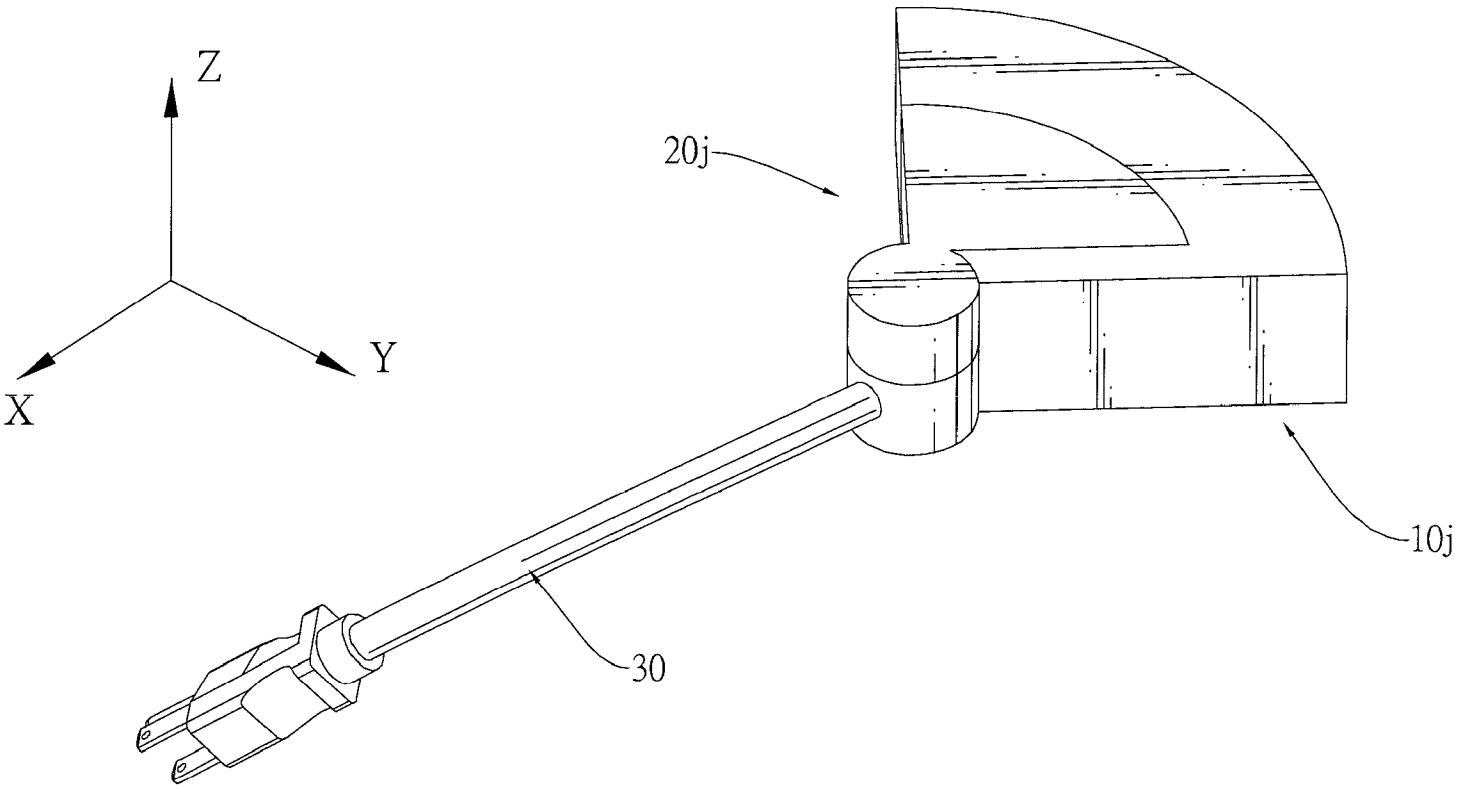
FIG. 19 is a perspective view of an eleventh embodiment of a power strip in accordance with the present invention.
Figure 20:
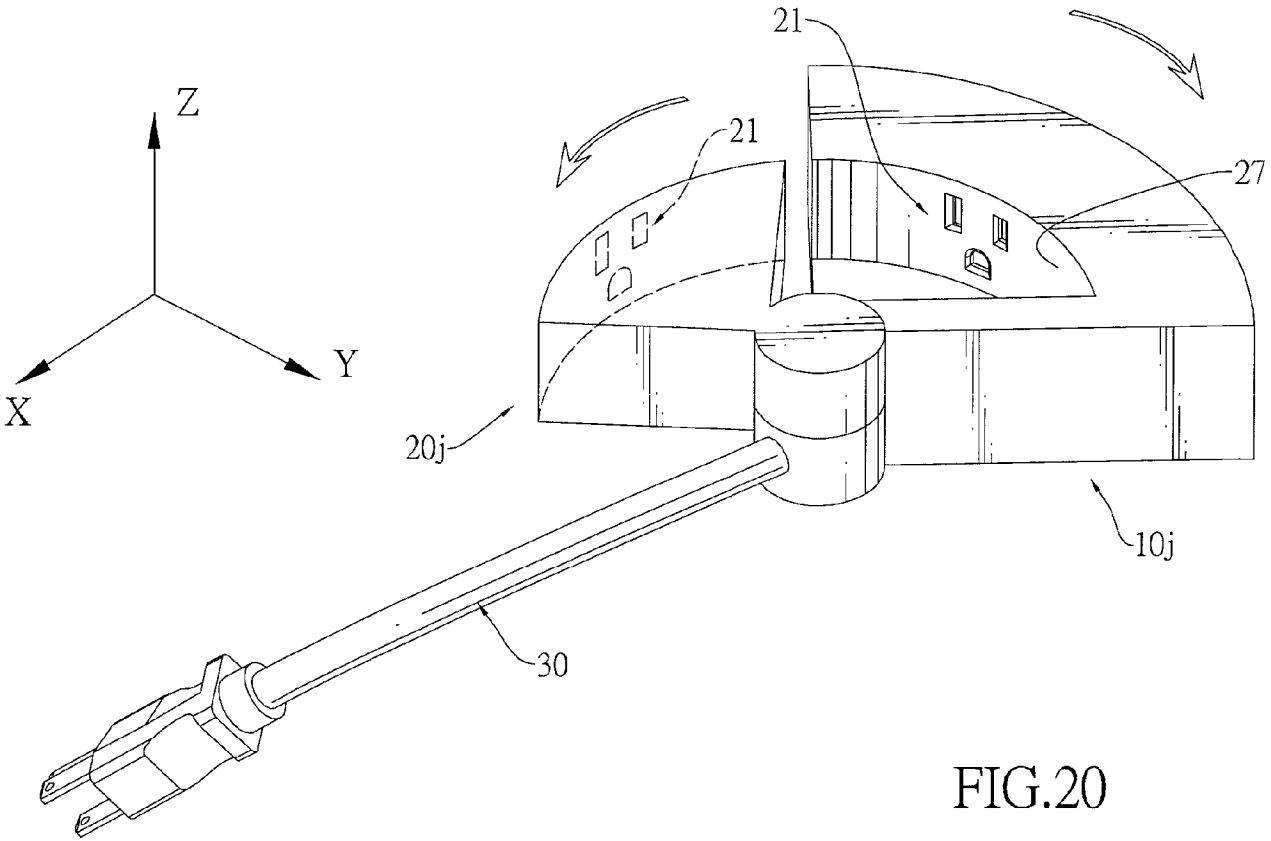
FIG. 20 is an operational perspective view of the power strip in FIG. 19.
Figure 21:
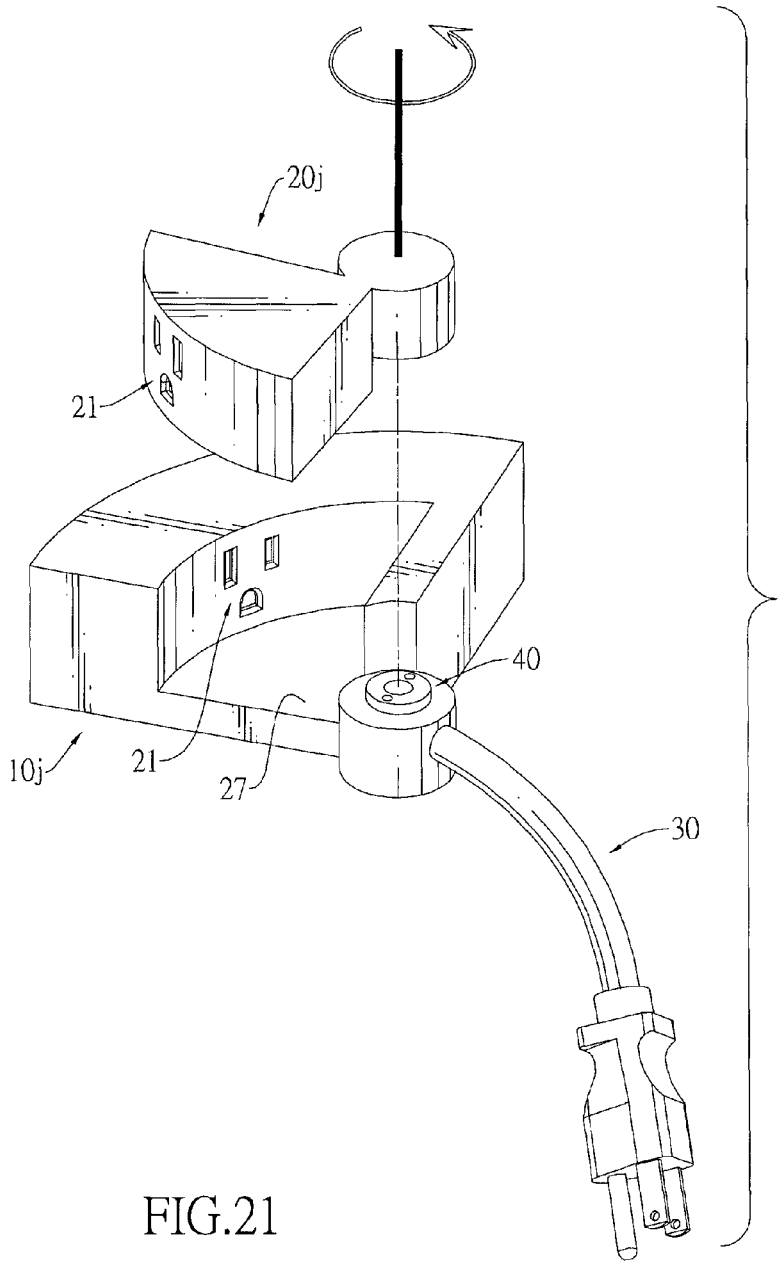
FIG. 21 is a partially exploded perspective view of the power strip in FIG. 19.

With reference to FIGS. 19 to 21, an eleventh embodiment of a power strip in accordance with the present invention has one stationary base (10*j*) and one rotating base (20*j*). The stationary base (10*j*) may be sector-shaped and has a recess (27) and at least one socket (21). The recess (27) is defined in the stationary base (10*j*) and has an inner lateral surface. The at least one socket (21) is mounted on the inner lateral surface and faces a direction being perpendicular to the Z-axis. The rotating base (20*j*) may be sector-shaped, is mounted rotatably on the stationary base (10*j*) through a pintle (40) paralleling the Z-axis, is capable of rotating around the Z-axis and is selectively engaged with the recess (27). The rotating base (20*j*) has an outer lateral surface and at least one socket (21) mounted on the outer lateral surface. The outer lateral surface and the inner lateral surface cover each other when the rotating base (20*j*) is engaged with the recess (27). The sockets (21) of the stationary and rotating bases (10*j*, 20*j*) are covered when the rotating base (20*j*) is engaged with the recess of the stationary base (10*j*). Furthermore, the power cable (30) is connected to the sockets (21) through the stationary base (10*j*).

Figure 22:
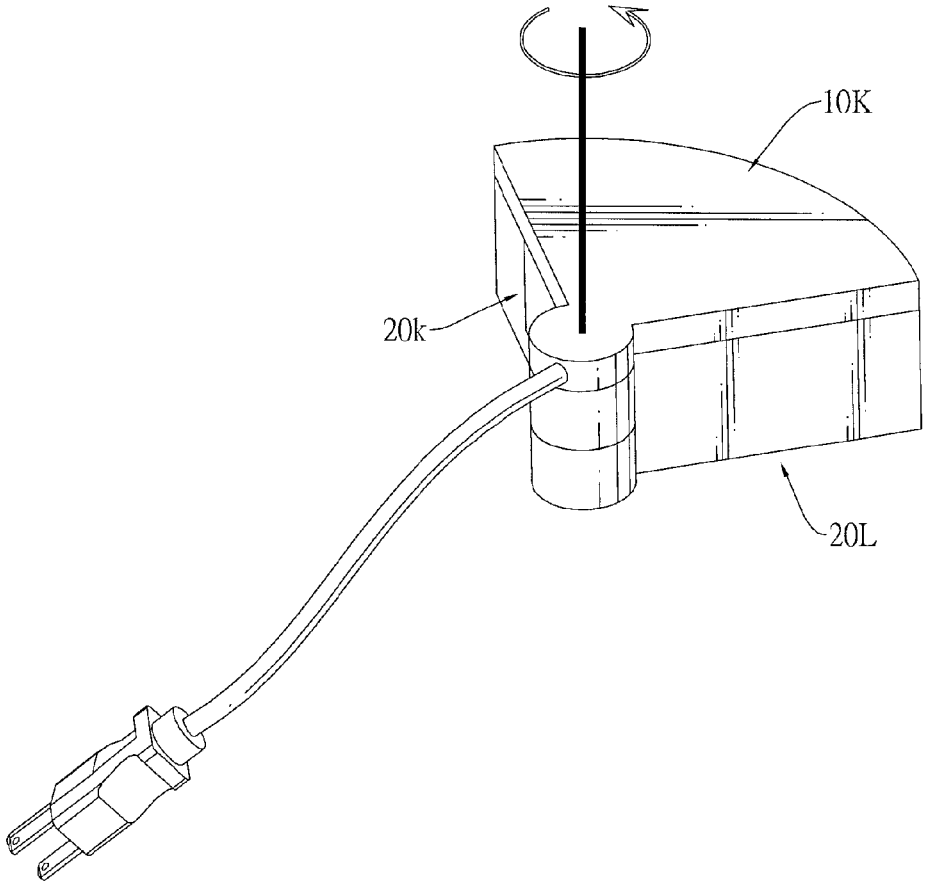
FIG. 22 is a perspective view of a twelfth embodiment of a power strip in accordance with the present invention.
Figure 23:
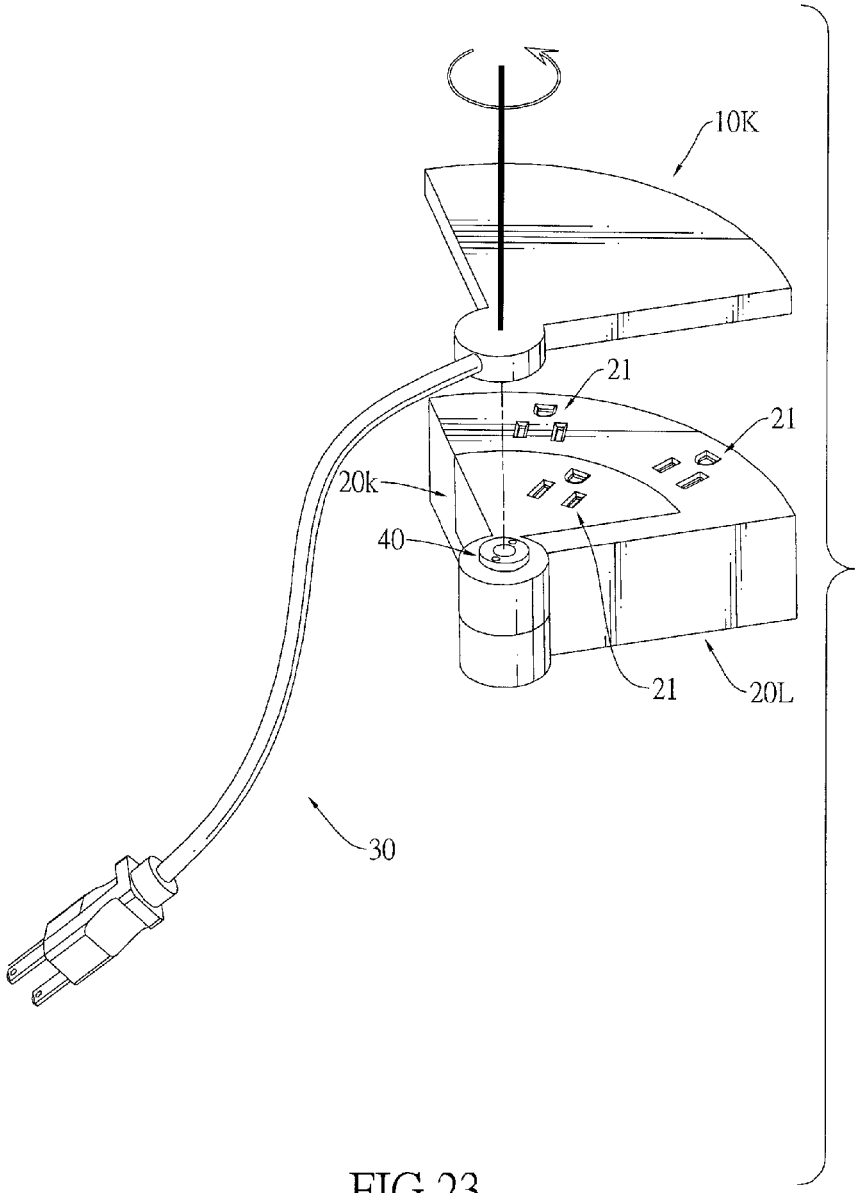
FIG. 23 is a partially exploded perspective view of the power strip in FIG. 22.
Figure 24:
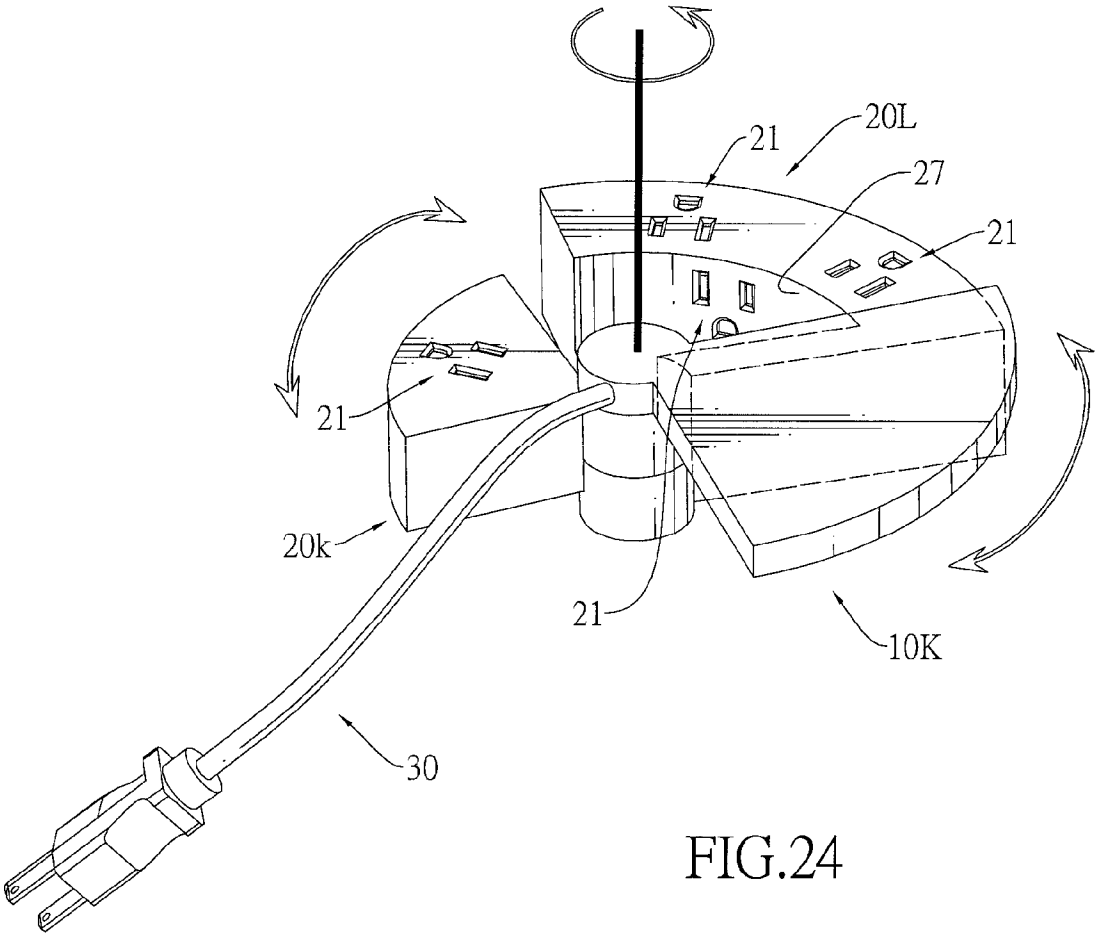
FIG. 24 is an operational perspective view of the power strip in FIG. 22.

With reference to FIGS. 22 to 24, a twelfth embodiment of a power strip in accordance with the present invention is similar to the eleventh embodiment and has a stationary (10*k*) and a first rotating base (20L) and a second rotating base (20*k*). The stationary base (10*k*) may be sector-shaped and is connected to the power cable (30). The first rotating base (20L) may be sector-shaped, is mounted rotatably on the stationary base (10*k*) and has at least one socket (21) and a recess (27). The at least one socket (21) is mounted on a top surface thereof and faces along the Z-axis. The recess (27) is defined in the first rotating base (20L). The second rotating base (20*k*) is mounted rotatably on the stationary base (10*k*), is selectively engaged with the recess (27) and has at least one socket (21) mounted on a top surface thereof facing along the Z-axis.

Because the sockets (21) may be selectively covered or revealed through the rotating mechanism between the stationary and rotating bases (10-10*k*, 20-20L, 30*i*), the power strip prevents malfunction and shorting problems due to dust accumulation or water permeation of the exposed sockets (21) and prevents children or animals from inserting objects or body parts into exposed sockets (21) for further safety improvements. Therefore, the safety of the power strip is greatly improved. Furthermore, the power strip may structurally switch between a socket-covered configuration that is compact and a socket-exposing configuration for use so that the power strip in the socket-covered configuration may be compact for transportation, storage and aesthetic purposes.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A power strip comprising:

a stationary base having a power cable; and a bottom surface;

a rotating base mounted rotatably on the stationary base and having a top surface adjacent to the bottom surface of the stationary base; and at least one socket mounted on the top surface and electrically connected to the power cable; and a pintle assembled perpendicularly to the top surface and rotatably connecting the rotating base to the stationary base, wherein the at least one socket is covered by the stationary base when the rotating base is rotated to align with the stationary base and is exposed to be accessible when the rotating base is turned apart from the stationary base crosswisely; wherein:

the pintle has a hole defined therethrough;

each socket of the rotating base has multiple blades mounted completely in the rotating base and each blade has a tab having a fastening end mounted in the stationary base; and a pivoting end being opposite to the fastening end, extending through the hole of the pintle and being mounted pivotally to the blade; and the power cable has at least one set of multiple wires and the wires of each set are connected respectively to the tabs of the blades of one of the at least one socket.

2. The power strip as claimed in claim 1, wherein the rotating base has multiple sockets mounted on the top surface.

3. The power strip as claimed in claim 1, wherein multiple rotating bases are mounted rotatably on the stationary base through a single pintle.

4. The power strip as claimed in claim 1, wherein multiple rotating bases are mounted rotatably on the stationary base respectively through multiple pintles that correspond to the rotating bases.

5. The power strip as claimed in claim 1, wherein multiple rotating bases are mounted rotatably on the stationary base respectively through multiple pintles and are arranged abreast when the rotating bases retract to cover the at least one socket of each rotating base.

6. The power strip as claimed in claim 1, wherein the stationary base has a foot for the power strip.

7. The power strip as claimed in claim 1, wherein the stationary base further has a lower base defining a slot between the stationary base and the lower base; and the rotating base is mounted rotatably in and selectively extends out of the slot.

8. The power strip as claimed in claim 1, wherein
the stationary base is polygonal and has
an intermediate portion; and
multiple spokes formed on and protruding from the intermediate portion and each spoke having a foot; and
a single rotating base is polygonal and has
an intermediate portion mounted rotatably on the intermediate portion of the stationary base; and
multiple strips formed on and protruding from the intermediate portion of the rotating base, corresponding to the spokes and each strip having at least one socket.

9. The power strip as claimed in claim 1, wherein the stationary base and multiple rotating bases are vertically stacked and rotatably connected to one another, and adjacent two of the stationary and rotating bases have one pintle mounted therebetween.

10. The power strip as claimed in claim 1, wherein
the stationary base has
a power cable; and
a bottom surface; and
a first rotating base is mounted rotatably on the stationary base and has
a top surface;
a bottom surface;
a recess; and
an inner lateral surface;
a socket mounted on the top surface and electrically connected to the power cable; and
at least one socket mounted on the inner lateral surface and electrically connected to the power cable; and
a second rotating base mounted rotatably on the stationary base and having
a top surface; and
an outer lateral surface;
a pintle assembled perpendicularly to the bottom surface and rotatably connecting the first rotating base to the stationary base:
a pintle assembled perpendicularly to the bottom surface of the first rotating base and rotatably connecting the second rotating base to the stationary base,
wherein the at least one socket of the first and second rotating bases is covered by the stationary base when the second rotating base is rotated to be engaged with the recess of the first rotating base and is exposed to be accessible when the rotating bases are turned out from the stationary base and the second rotating base is disengaged from the recess of the first rotating base.

11. A power strip comprising:
a stationary base having
a power cable;
a recess defined in the stationary base; and
an inner lateral surface; and
a rotating base mounted rotatably on the stationary base and having
a top surface;
an outer lateral surface; and
at least one socket mounted on the outer lateral surface and electrically connected to the power cable; and
a pintle assembled perpendicularly to the top surface and rotatably connecting the rotating base to the stationary base,
wherein the at least one socket is covered by the stationary base when the rotating base is rotated to be engaged with the recess and is exposed to be accessible when the rotating base is turned out from the stationary base and is not to be engaged with the recess; wherein:
the pintle has a hole defined therethrough;
each socket of the rotating base has multiple blades mounted completely in the rotating base and each blade has a tab having
a fastening end mounted in the stationary base; and
a pivoting end being opposite to the fastening end, extending through the hole of the pintle and mounted pivotally to the blade; and
the power cable has at least one set of multiple wires and the wires of each set are connected respectively to the tabs of the blades of the socket.

12. The power strip as claimed in claim 11, wherein the stationary base further has at least one socket mounted on the inner lateral surface.

* * * * *